US006827402B2

(12) United States Patent
Habermann et al.

(10) Patent No.: US 6,827,402 B2
(45) Date of Patent: Dec. 7, 2004

(54) CHAIR WITH ADJUSTABLE SEAT DEPTH

(75) Inventors: Jutta Habermann, Wutoeschingen-Degernau (DE); Bernhard Kallup, Weilheim-Remetschwiel (DE); Artur Wuerth, Kuessaberg-Reckingen (DE); Juergen Schillinger, Lautenburg-Binzgen (DE)

(73) Assignee: Sedus Stoll AG, Waldshut (DE)

( * ) Notice: Subject to any disclaimer, the term of this patent is extended or adjusted under 35 U.S.C. 154(b) by 46 days.

(21) Appl. No.: 10/058,381

(22) Filed: Jan. 30, 2002

(65) Prior Publication Data

US 2003/0067200 A1 Apr. 10, 2003

(30) Foreign Application Priority Data

Oct. 10, 2001 (EP) ..... 01124069

(51) Int. Cl.[7] ..... A47C 1/023
(52) U.S. Cl. ..... 297/337
(58) Field of Search ..... 297/317, 337, 297/341, 344.1

(56) References Cited

U.S. PATENT DOCUMENTS 3,982,785 A * 9/1976 Ambasz ..... 297/337
4,084,850 A * 4/1978 Ambasz ..... 297/317
5,035,466 A 7/1991 Mathews et al.
5,755,488 A 5/1998 Beda et al.
6,027,168 A * 2/2000 Crossman et al. ..... 297/337
6,193,313 B1 2/2001 Jonsson

FOREIGN PATENT DOCUMENTS

| | | |
|---|---|---|
| DE | 199 41 914 | 4/2001 |
| FR | 1 529 439 | 6/1968 |
| WO | WO 99/63866 | 12/1999 |

* cited by examiner

*Primary Examiner*—Peter R. Brown
(74) *Attorney, Agent, or Firm*—Oblon, Spivak, McClelland, Maier & Neustadt, P.C.

(57) ABSTRACT

The invention relates to a chair with adjustable seat depth, wherein the seat of the chair consists of a rigid seat support plate (1) and a sliding and ductile seat cushion plate (2), on which the seat cushion is arranged. The invention is characterized by the fact that the seat cushion plate (2) contains a flexible area (7), which forms a seat trough, that on the seat support plate (1) two lateral guide rails (8) are arranged, in which the seat cushion plate (2) can be displaced with guide ribs (6) that are incorporated in said plate and that between the seat support plate (1) and the seat cushion plate (2) a device (15) for improving the sliding characteristics, preferably a polyethylene foil that is coated with Teflon, is arranged. The chair is characterized by very good sitting comfort.

8 Claims, 2 Drawing Sheets

CHAIR WITH ADJUSTABLE SEAT DEPTH

TECHNICAL FIELD

The invention relates to the field of the furniture industry. It involves a chair with adjustable seat depth.

STATE OF THE ART

Different technical solutions for chairs are known, with which the seat depth of the chair can be adjusted to the respective user's leg length.

For example in the Chicago model revealed by the applicant the entire seat can be moved forward (or back) on a rail. The disadvantage of this system is that the entire seat trough, the front over arch for the support of the thighs as well as the support for the iliac crest move forward and thus the distance to the backrest support point increases. This way optimal sitting is no longer possible.

We also know of a chair from Sitag company with a seat that is divided into two parts, where one part of the seat slides beneath the other part and thus a seat depth adjustment occurs. This technical solution has the disadvantage that the cushion is separated in the front area and thus no continuous surface exists. This leads to an unpleasant sitting experience for the user. Additionally pressure points can arise during sitting.

Finally we know from the magazine Office Design from Jun. 3, 2000, p. 65 of an office chair with a sliding seat, where the cushion plate of the chair is pulled over a wedge for iliac crest support. The iliac crest support should always remain in a fixed position to the back when changing the seat depth. Although new cushion technology, where the cushion foam in the marginal areas and in the areas of the legs is firmer than in the area on which the thighs rest, ensures high sitting comfort, this comfort however is reduced again disadvantageously due to the lacking seat trough.

PRESENTATION OF THE INVENTION

The invention attempts to avoid the above-mentioned disadvantage of the familiar state of the art. Its objective is to create a chair with adjustable seat depth, where the seat depth can be adjusted without difficulty to the different lengths of users' legs and where the seat trough always remains in the same position so that extremely high sitting comfort is guaranteed.

According to the invention this is accomplished with a chair pursuant to the generic description of patent claim 1 in that the seat cushion plate contains a flexible area, which forms a seat trough, that on the seat support plate two lateral side rails are arranged, in which the seat cushion plate can be displaced through guide ribs that are incorporated in this plate, and that between the seat support plate and the seat cushion plate a device for improving the sliding characteristics is arranged.

The advantages of the invention are that with the invented sliding seat the seat trough for the user remains in the optimal position and that the seat depth can be exactly adjusted to the length of the respective user's legs. Solely the movement of the user leads to a deformation of the seat cushion plate. This way excellent sitting comfort is achieved.

It is useful when at least three guide ribs are provided on the seat cushion plate for each lateral guide track of the seat support plate. This zipper principle leads to exact contour guidance. Although the seat cushion plate largely matches the outline of the seat support plate from a design point of view, it is not congruent with it but rather bent downward by a certain degree so that a an arch created. The parts are therefore mounted under tension.

Furthermore it is beneficial when the device for improving the sliding properties is a foil, which consists of polyethylene and is coated with Teflon and which is fastened to the seat support plate through a clamp. The seat cushion plate can then glide particularly well on the seat support plate so that the seat depth can be adjusted very easily and in a user-friendly manner.

It is advantageous when the seat cushion plate consists of ductile resin, which is particularly ductile in the flexible area due to a special interrupted outline.

Furthermore it is useful when the seat cushion plate can be fastened with the help of sliding blocks that are screwed into the fastening domes of the seat support plate and the sliding blocks form a stop to the front and/or the back for displacement of the seat cushion plate.

It is beneficial when on the seat support plate a arresting button is provided for a graduated arresting of the seat cushion plate. This way the seat depth can be adjusted exactly to the respective needs and be locked in place.

Finally it is useful when the seat cushion plate contains a maximum displacement area of about 60 mm.

BRIEF DESCRIPTION OF THE DRAWING

The drawing depicts an embodiment of the invention.

The figures show.

Only elements that are important for gaining an understanding of the invention are shown.

WAYS FOR EXECUTING THE PRESENTATION

Figure 1:
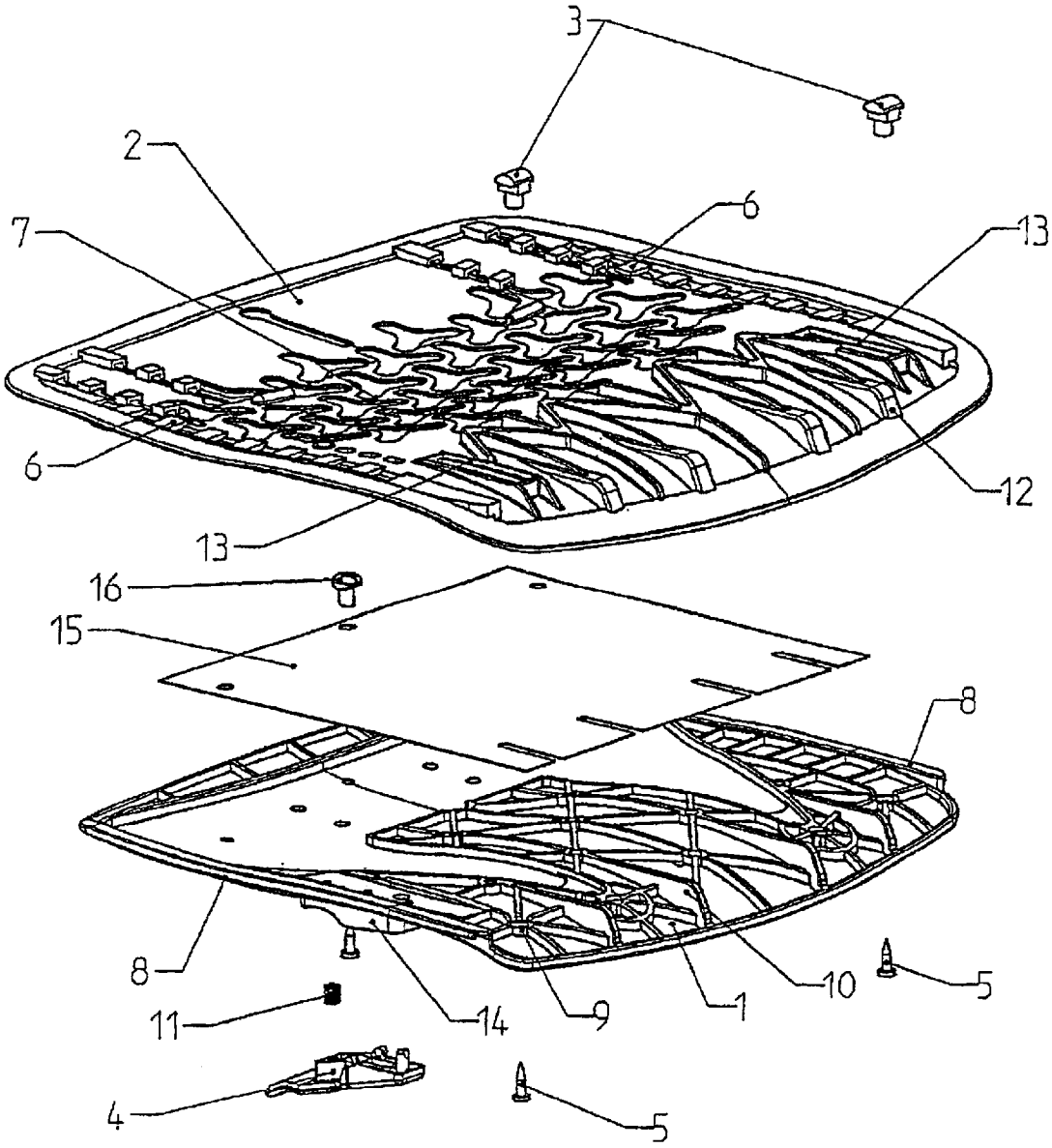
FIG. 1 an invented sliding seat with seat cushion plate and seat support plate in exploded view.
Figure 2:
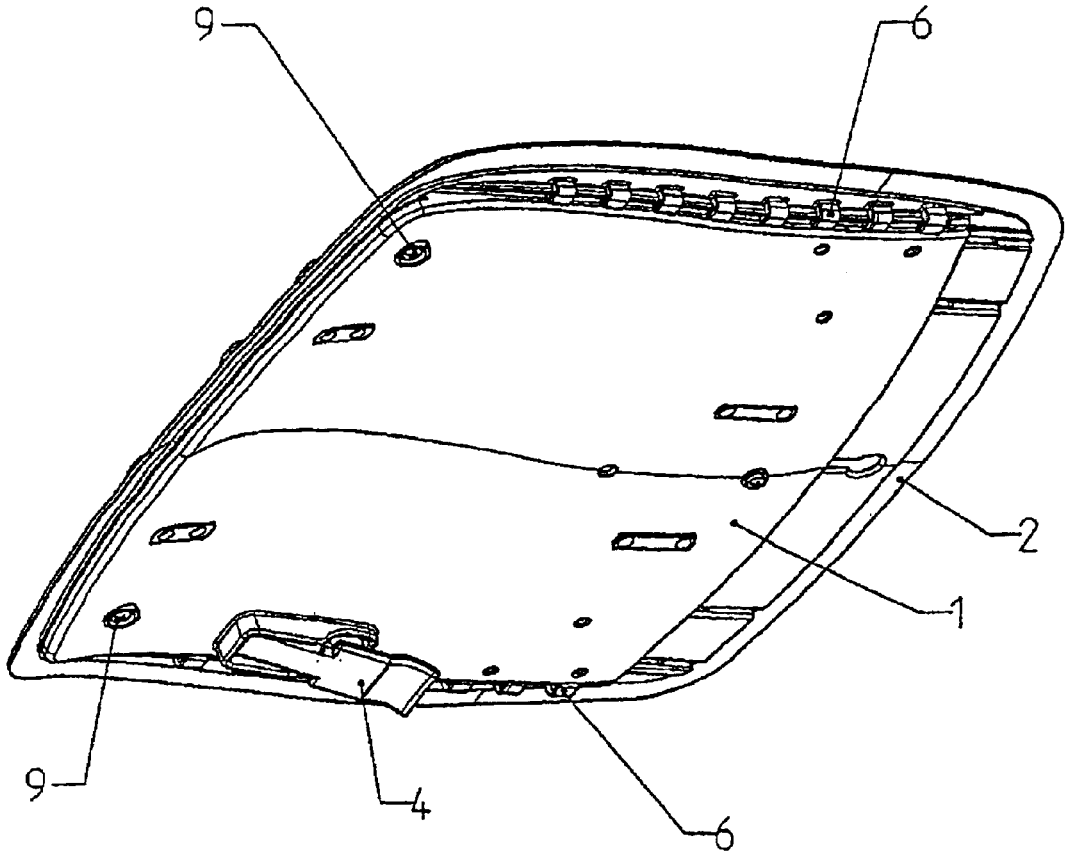
FIG. 2 a bottom view of the assembled sliding seat pursuant to FIG. 1.

The following explains the invention based on an embodiment and the FIGS. 1 and 2.

FIG. 1 shows an invented seat of a swivel office chair with seat depth adjustment in a perspective exploded view. The sliding seat basically consists of a seat support plate 1 and a seat cushion plate 2 that is arranged on top of that.

On its sides the seat support plate 1 contains a lateral guide rail 8, respectively, which extends from the rear end of the seat support plate 1 up to close to the front end of the seat support plate 1. In the front area of the seat support plate 1 two fastening domes 9 are arranged as well as a variety of support ribs 11, which extend upward. The seat support plate 1 has a curved outline with a seat trough. On its bottom a holding device 14 for holding a arresting button 4 is arranged, which can be actuated by a pressure spring 11. With the help of the arresting button 4, a step-by-step arresting of the seat cushion plate 2 is made possible. In the present example e.g. four different positions are possible.

The seat cushion plate 2 contains a flexible area 7, which is characteristic for the invention and which forms the seat trough of the chair, as well as several laterally arranged guide ribs 6. At least three guide ribs, respectively, should be incorporated. The seat cushion plate 2 is preferably made of ductile resin. The flexible area 7 has a special interrupted outline, which ensures particularly great ductility. This outline is realized in the present embodiment by stamping a multitude of offset areas out of the seat cushion plate 2, which have a triangular shape with sides that are arched inward. The remaining space between neighboring sides is thus reduced to a minimum. The remaining rails ensure on one hand still sufficient stability of the seat cushion plate 2 in the flexible area 7, on the other hand a particularly great ductility. Although the seat cushion plate 2 largely matches the outline of the seat support plate 1 from a design point of view, it is not congruent with it but rather bent downward by a certain degree, in this case by about 10 mm, so that an arched area is created. In the front area of the seat cushion plate 2 convexities 12 are provided for holding the support ribs 10 of the seat support plate 1 as well as two guide grooves 13 with a front and a rear stop for sliding blocks 3.

In order to improve the sliding characteristics, a foil 15 is arranged between the seat support plate 1 and the seat cushion plate 2. The foil 15 consists of polyethylene in the present embodiment and is coated with Teflon on its surface. The foil is about 0.5 mm thick. With the help of at least one mushroom-shaped clamp 16 the foil 15 is held on the seat support plate 1. On the side opposite to the clamp 16, the foil 15 is slit in such a way that the support ribs 10 of the seat support plate 1 penetrate through the foil 15 in these areas. In another embodiment, instead of the foil a separate sliding device can be incorporated on the seat support plate 1 and/or the seat cushion plate 2 as a device 15 for improving the sliding characteristics.

The seat support plate 1 and the seat cushion plate 2 are fastened with the sliding blocks 3, which are screwed together with screws 5 in the fastening domes 9. The guide ribs 6 of the seat cushion plate 2 are arranged in the guide rails 8 of the seat support plate. Since the seat cushion plate 2 largely matches the outline of the seat support plate 1 from a design point of view, but is not congruent with it, parts 1 and 2 are therefore assembled under tension. They are also under tension when the sliding seat is being used.

FIG. 2 shows a bottom view of the assembled sliding seat.

The invented sliding seat functions as follows: The user sits down on the chair, releases the locked position of the seat cushion plate 2 in the seat support plate 1 by pushing the arresting button 4 and slides the scat cushion plate 2 forward or backward depending on the user's leg length. The guide ribs 6 now slide in the guide rails 8 and the sliding blocks 3 in the guide grooves 13. This motion leads to a deformation of the flexible area 7 of the seat cushion plate 2. When optimal adjustment of the seat depth for the length of the legs has been reached, the arresting button is released and the seat cushion plate 2 is fixed in place. The advantage of this solution consists of the fact that the seat trough is in exactly the optimal position for each user and that the seat depth is exactly adjusted to the respective user's leg length. This way excellent sitting comfort is reached.

Of course the invention is not limited to the embodiment described here, for example also other materials can be used for the seat support plate 1 and the seat cushion plate 2. The only important factor is that the seat cushion plate 1 is ductile and that the pairing of the materials from parts 1 and 2 does not prevent a sliding motion.

Reference List

1 Seat Support Plate
2 Seat Cushion Plate
3 Inserted Tongue
4 Arresting Button
5 Screw
6 Guide Rib from Pos. 2
7 Flexible Area from Pos. 2
8 Guide Rail from Pos. 1
9 Fastening Dome in Pos. 1 for Pos. 3
10 Support Rib
11 Pressure Spring for Pos. 4
12 Convexity in Pos. 2 for holding Pos. 10
13 Guide Groove for Pos. 3
14 Holding Device for Pos. 4
15 Device for improving sliding characteristics, e.g. foil
16 Clamp

What is claimed is:

1. A chair with adjustable seat depth, comprising:

a seat having a rigid seat support plate and a sliding and ductile seat cushion plate having a seat cushion arranged thereon, the sliding and ductile seat cushion plate including a flexible area forming a seat trough, the rigid seat support plate having two lateral guide rails arranged thereon, the sliding and ductile seat cushion plate being provided with guide ribs configured to displace the sliding and ductile seat cushion plate on the two lateral guide rails; and a sliding improvement device positioned between the rigid seat support plate and the sliding and ductile seat cushion plate for improving sliding characteristics, wherein the sliding and ductile seat cushion plate is fastened to the rigid seat support plate by engaging sliding blocks with fastening domes of the rigid seat support plate via screws, and the sliding blocks form a stop to at least one of front and back for displacement of the sliding and ductile seat cushion plate.

2. The chair in accordance with claim 1, wherein the sliding improvement device comprises a foil fastened to the rigid seat support plate with at least one fastening device.

3. The chair in accordance with claim 2, wherein the foil comprises polyethylene and is coated with polytetrafluorethylene.

4. The chair in accordance with claim 1, wherein the sliding improvement device comprises a sliding layer applied separately to at least one of the rigid seat support plate and sliding and ductile seat cushion plate.

5. The chair in accordance with claim 1, further comprising at least three guide ribs positioned on the sliding and ductile seat cushion plate and provided for each of the two lateral guide rails of the rigid seat support plate.

6. The chair in accordance with claim 1, wherein the sliding and ductile seat cushion plate comprises ductile resin and having a flexible portion.

7. The chair in accordance with claim 1, further comprising an arresting device configured to arrest the sliding and ductile seat cushion plate in a graduated manner.

8. The chair in accordance with claim 1, wherein the sliding and ductile seat cushion plate has a maximum displacement range of about 60 mm.

* * * * *